US011021221B2

(12) United States Patent
Godoy

(10) Patent No.: US 11,021,221 B2
(45) Date of Patent: Jun. 1, 2021

(54) MASK FOR SURFACE SNORKELING

(71) Applicant: Cressi-Sub S.P.A., Genoa (IT)

(72) Inventor: Carlos Alberto Godoy, Genoa (IT)

(73) Assignee: Cressi-Sub S.P.A., Genoa (IT)

( * ) Notice: Subject to any disclaimer, the term of this patent is extended or adjusted under 35 U.S.C. 154(b) by 406 days.

(21) Appl. No.: 16/203,850

(22) Filed: Nov. 29, 2018

(65) Prior Publication Data

US 2020/0017179 A1 Jan. 16, 2020

(30) Foreign Application Priority Data

Jul. 16, 2018 (IT) ..... 1020180007235

(51) Int. Cl.
*B63C 11/16* (2006.01)
*B63C 11/20* (2006.01)

(52) U.S. Cl.
CPC ..... *B63C 11/16* (2013.01); *B63C 11/205* (2013.01)

(58) Field of Classification Search
CPC . B63C 11/16; B63C 11/205; B63C 2011/165; B63C 11/12; B63C 11/207; B63C 11/06; A62B 18/04; A62B 18/10
See application file for complete search history.

(56) References Cited

U.S. PATENT DOCUMENTS

2016/0297505 A1* 10/2016 Caprice ..... B63C 11/16

* cited by examiner

*Primary Examiner* — Margaret M Luarca
(74) *Attorney, Agent, or Firm* — Blank Rome LLP

(57) ABSTRACT

A mask for surface snorkeling includes a rigid frame (2), a transparent visor (3), a soft face mask (4) sealingly applicable to the face of the user and having a membrane (7) which delimits an upper viewing chamber (8) being shaped to contain the eyes of the user and a lower breathing chamber (9) being shaped to contain the nose and the mouth of the user, and a breathing circuit (5) connected to the lower chamber (9), a ventilation circuit of the upper chamber (8) being further provided that is independent of and separated from the breathing circuit (5).

15 Claims, 6 Drawing Sheets

MASK FOR SURFACE SNORKELING

RELATED APPLICATIONS

This application claims benefit of priority of Italy Patent Application No. 102018000007235, filed Jul. 16, 2018. The above-identified related application is incorporated by reference.

FIELD OF USE

This invention relates to a mask for surface snorkeling.

BACKGROUND OF THE INVENTION

A mask for surface snorkeling of known type has a rigid frame, a transparent visor, a soft face mask sealingly applicable to the face, a breathing tube with floating shutter, and a strap that is applicable around the head to keep the mask in position.

In a certain type of mask for surface snorkeling that is commercially widespread today, the visor is configured to be applied to the entire oval of the face and for this purpose it has a membrane internally that delimits an upper viewing chamber being shaped to contain the eyes and a lower breathing chamber being shaped to contain the nose and mouth.

In this type of mask it is inevitable that the humid air, in particular that produced by breathing, may cause the visor to fogging up, reducing the snorkeler's viewing capacity.

Various attempts have been made to reduce the occurrence of fogging up of the visor.

CN204173146U reveals a mask of this type in which the membrane is provided with at least one one-way valve that enables air passage from the upper chamber to the lower chamber when the pressure difference reaches a predetermined value. The breathing tube has three parallel conduits: the central conduit, the entry conduit, places the external environment (air) in contact with the upper chamber. From the upper chamber the air can pass into the lower chamber through the quoted one-way valve that is opened by the depression created by the user through inhalation. The other two conduits of the breathing tube connect to two outlet conduits that lead away from the lower chamber. When in the lower chamber of the mask overpressure is created that is generated by the exhalation of the user, the exhaled air is conveyed in the outlet conduits that emerge at the upper end of the breathing tube. The end of the breathing tube ends with a passage chamber that is in communication with the outside air at the moment in which the floating shutter moves to the open position. The passage chamber communicates with the three tubes mentioned, one inlet tube, for inhalation, and two symmetrical outlet tubes for exhalation, through one-directional valves. Accordingly, when the user inhales, the depression created by him has to overcome the resistance of two arranged in series one-way valves; the one-way valve between the passage chamber and the descending conduit situated in the breathing tube and the one-way passage valve between the upper chamber and the lower chamber. When the user breathes out, the pressure created by the user has to overcome the resistance of the one-way valve between the outlet conduit of the breathing tube and the passage chamber. The air that in the inhalation step crosses the upper chamber acts as washing, i.e. renews the air present in the upper chamber to reduce possible fogging up created by inhaled air stagnation in the upper chamber.

Other masks of this type are disclosed for example in CN204548450U and in WO 2015/170013.

All these types of mask have in common the fact that they provide at least one one-way valve in the breathing circuit.

In order to eliminate fogging up of the visor, the flow of aspirated air in fact first enters the chamber of the visor and then through a one-way valve it passes into the breathing chamber from which it is subsequently expelled.

The breathing circuit thus includes in series the upper chamber and the lower chamber and the provision of one or more one-way valves, provided in the separating membrane between the upper chamber and lower chamber and sometimes also in the passage chamber at the end of the breathing tube, noticeably increase the inhaling and exhaling effort.

SUMMARY OF THE INVENTION

The technical task of this invention is to make a mask for surface snorkeling that avoids fogging up of the visor without increasing breathing effort.

The technical task, and these and other objects, are achieved according to this invention by providing a mask for surface snorkeling comprising a rigid frame, a transparent visor, a soft face mask sealingly applicable to the face of the user and having a membrane that delimits an upper viewing chamber being shaped to contain the eyes of the user and a lower breathing chamber being shaped to contain the nose and the mouth of the user, characterised in that it comprises a first two-directional circuit of forced air exchange induced by the breath of the user, said first circuit connecting said lower chamber with the external atmospheric environment, and a second bidirectional circuit of convective air exchange induced by the temperature difference between the upper chamber and the external atmospheric environment, said second circuit connecting the upper chamber with the external atmospheric environment for aeration the upper chamber and comprising a diffuser extending inside the upper chamber to the zone in front of the eyes of the user.

The diffuser has a tubular shape.

In one embodiment, the diffuser is delimited by the internal wall of the visor and by an independent marking out element mounted on the internal wall of the visor.

The first circuit comprises a first conduit connecting said lower chamber to the atmospheric environment external to the mask, and said second circuit comprises a second conduit connecting said upper chamber to the atmospheric environment external to the mask.

Said first and second conduits are equipped with floating shutter means.

Advantageously, said first conduit has a passage section which is free throughout its length when said shutter means is in an open position, thus establishing a direct air connection of said lower chamber to the atmospheric environment external to the mask.

Advantageously, said second conduit has a passage section which is free throughout its length when said shutter means is in an open position, thus establishing a direct air connection of said upper chamber to the atmospheric environment external to the mask.

Unlike the prior art technical solutions, the membrane according to the invention avoids fogging up of the visor without requiring a greater breathing effort because there are no one-way valves to open to connect with the external atmospheric environment, as the connection of the lower chamber with the external atmospheric environment is direct when the floating shutter means is in an open position.

Also the ventilation process is effective, not implying the opening of a one-way valve as also the connection of the upper chamber with the external atmospheric environment is direct when the floating shutter means is in the open position.

Fogging up of the visor is thus avoided without creating an air circuit that crosses serially the upper chamber and the lower chamber. It has thus been seen that unexpectedly it suffices to place the upper chamber in free communication with the atmospheric environment external to the mask to prevent the visor fogging up.

Advantageously, providing a diffuser inside the upper chamber in the direction of the zone in front of the eyes enables the visor to be defogged uniformly, especially in the zone in front of the eyes of the user so as to permit a clear view over a wide visual field.

On the other hand, when during surface snorkeling the head of the user is immersed temporarily, the floating shutter means in the closed position prevents the water entering the viewing chamber and the breathing chamber.

BRIEF DESCRIPTION OF THE DRAWINGS

Further features and advantages will become clearer from the detailed description of an embodiment of the mask for surface snorkeling according to the invention, illustrated by way of non-limiting example in the attached figures, in which.

DETAILED DESCRIPTION OF THE ILLUSTRATED EMBODIMENTS

Figure 1:
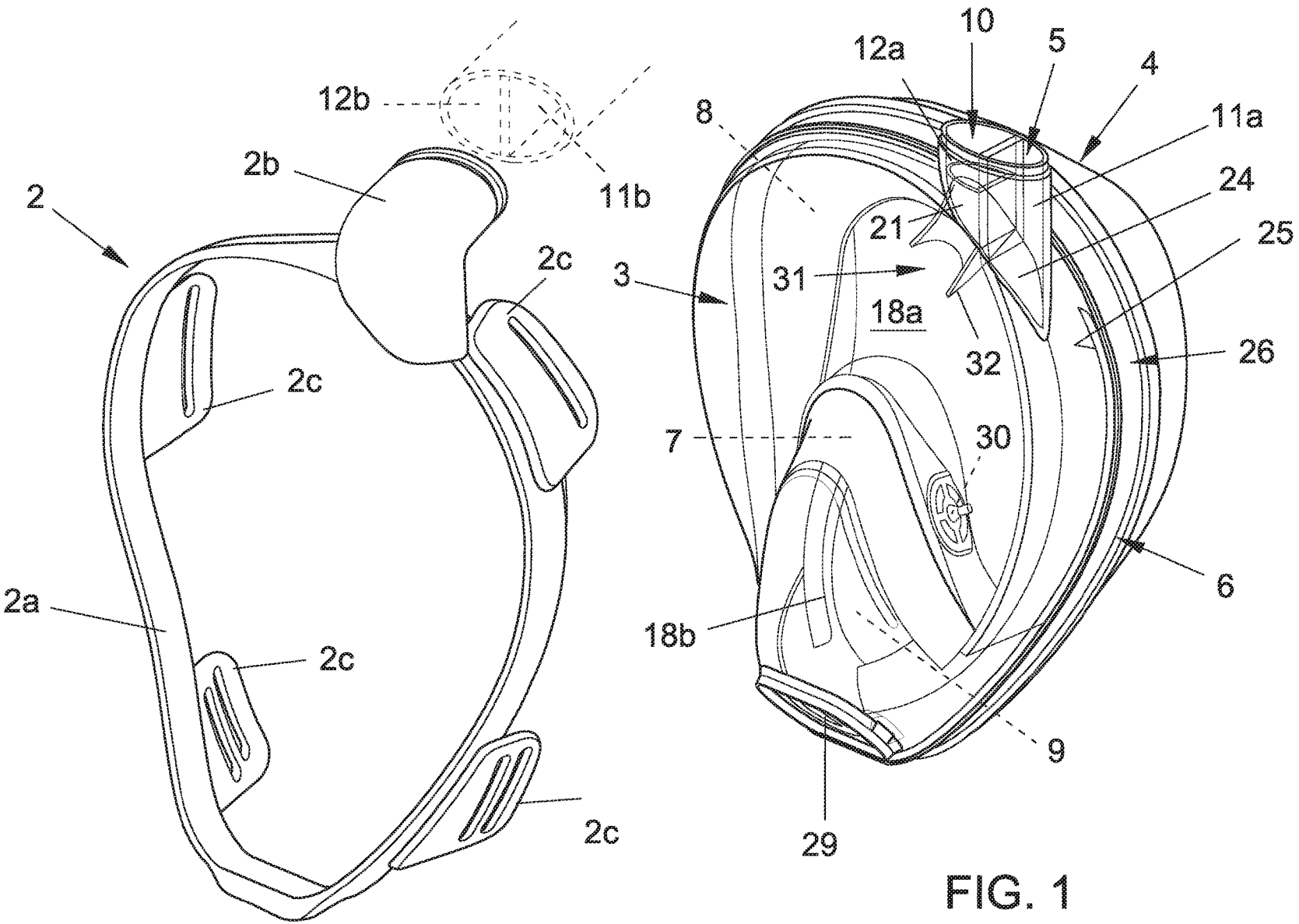
FIG. 1 shows an exploded view of the mask.
Figure 2:
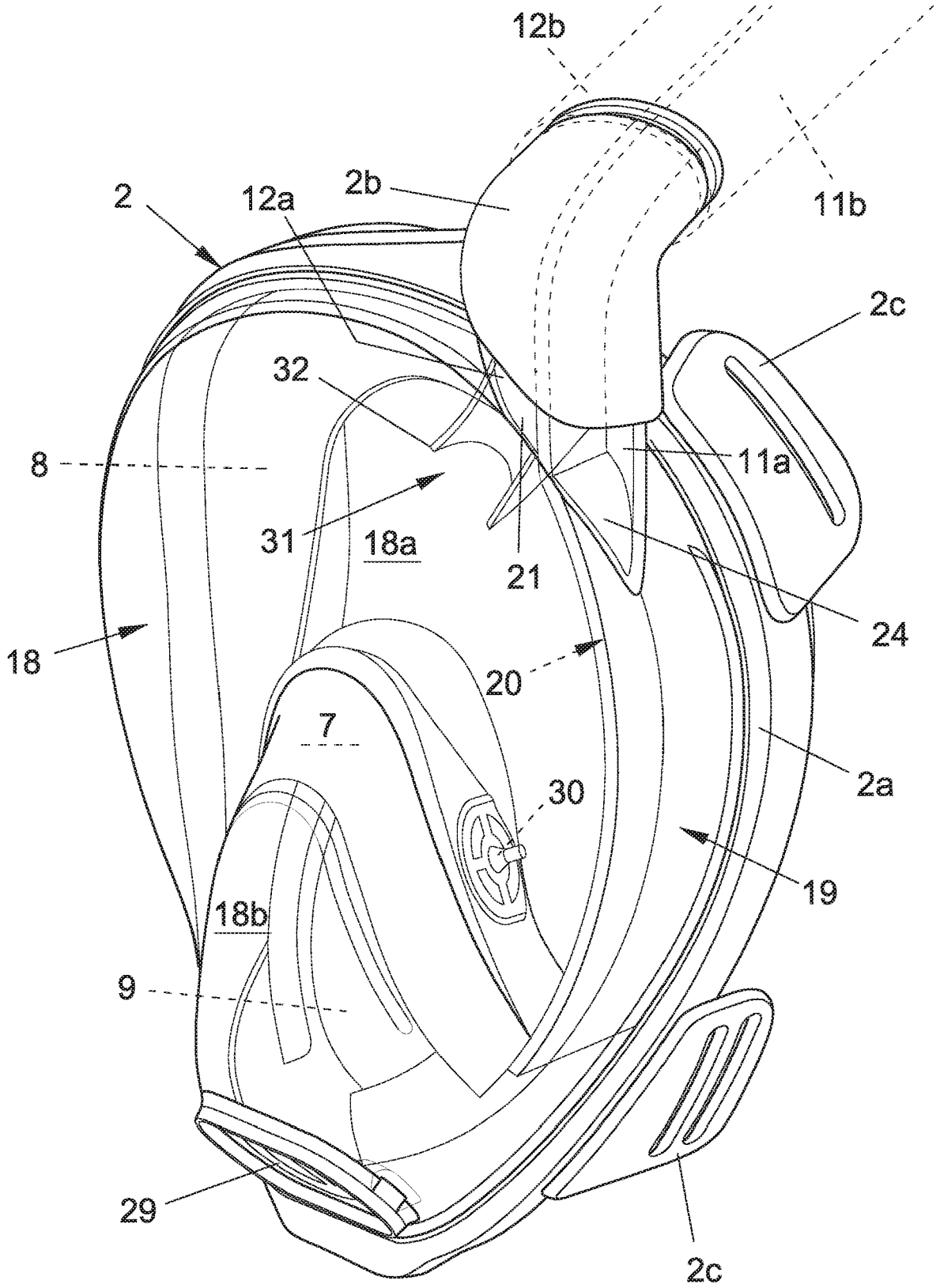
FIG. 2 shows a front perspective view of the mask.
Figure 3:
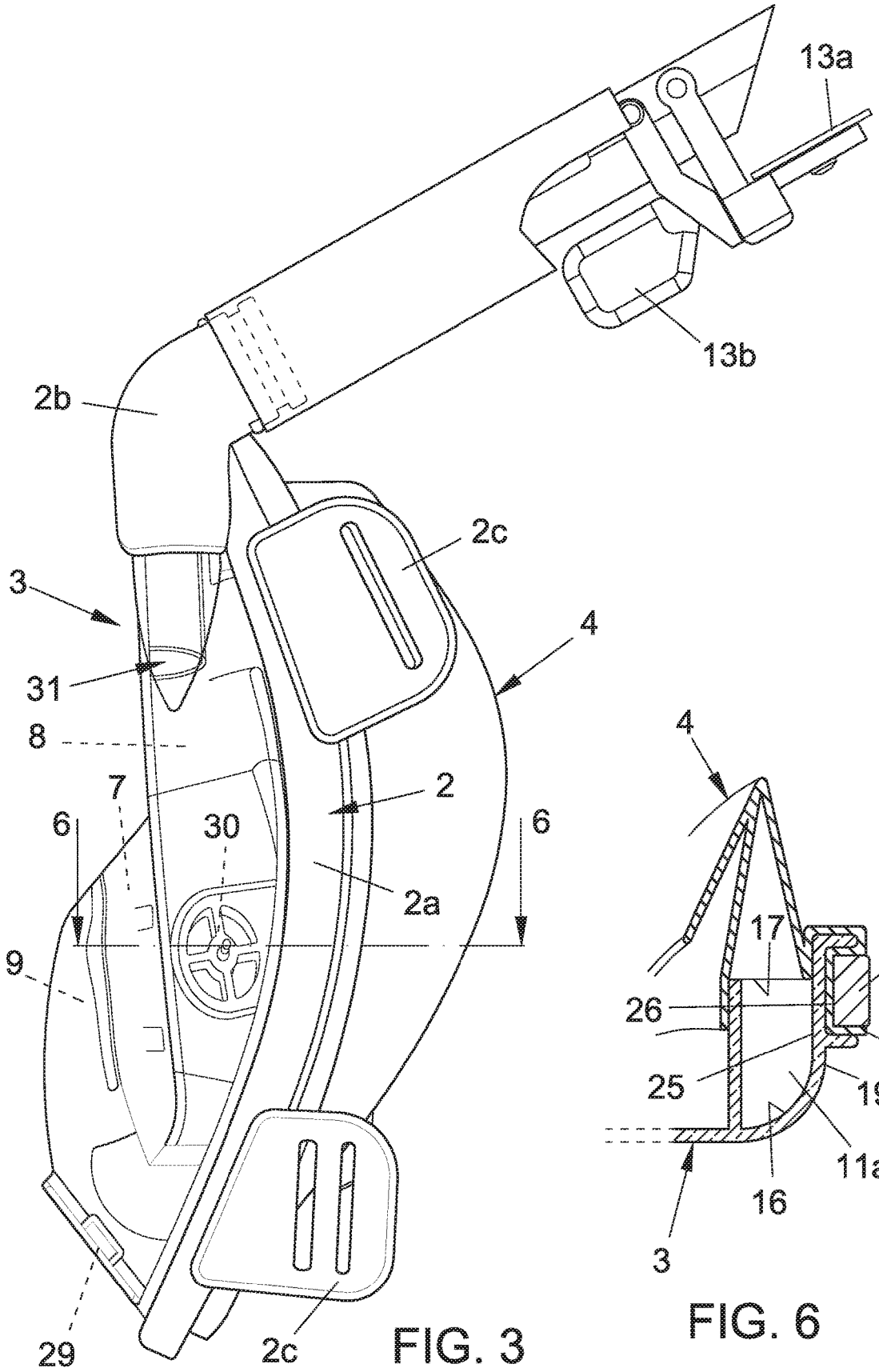
FIG. 3 shows a side raised view of the mask.
Figure 6:
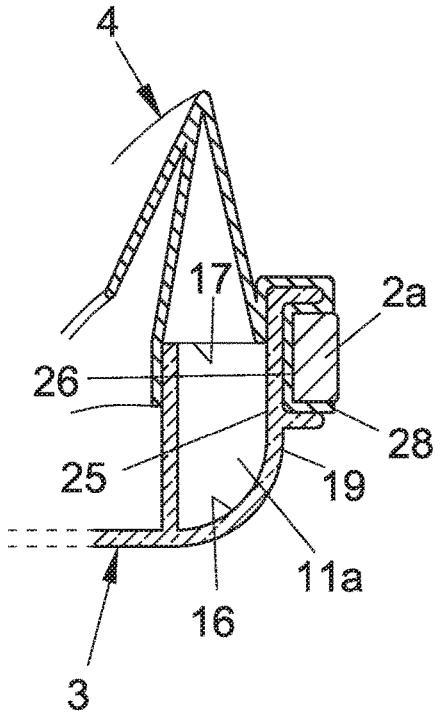
FIG. 6 shows a cross section of the breathing conduit, taken along line 6-6 of the figure.
Figure 4:
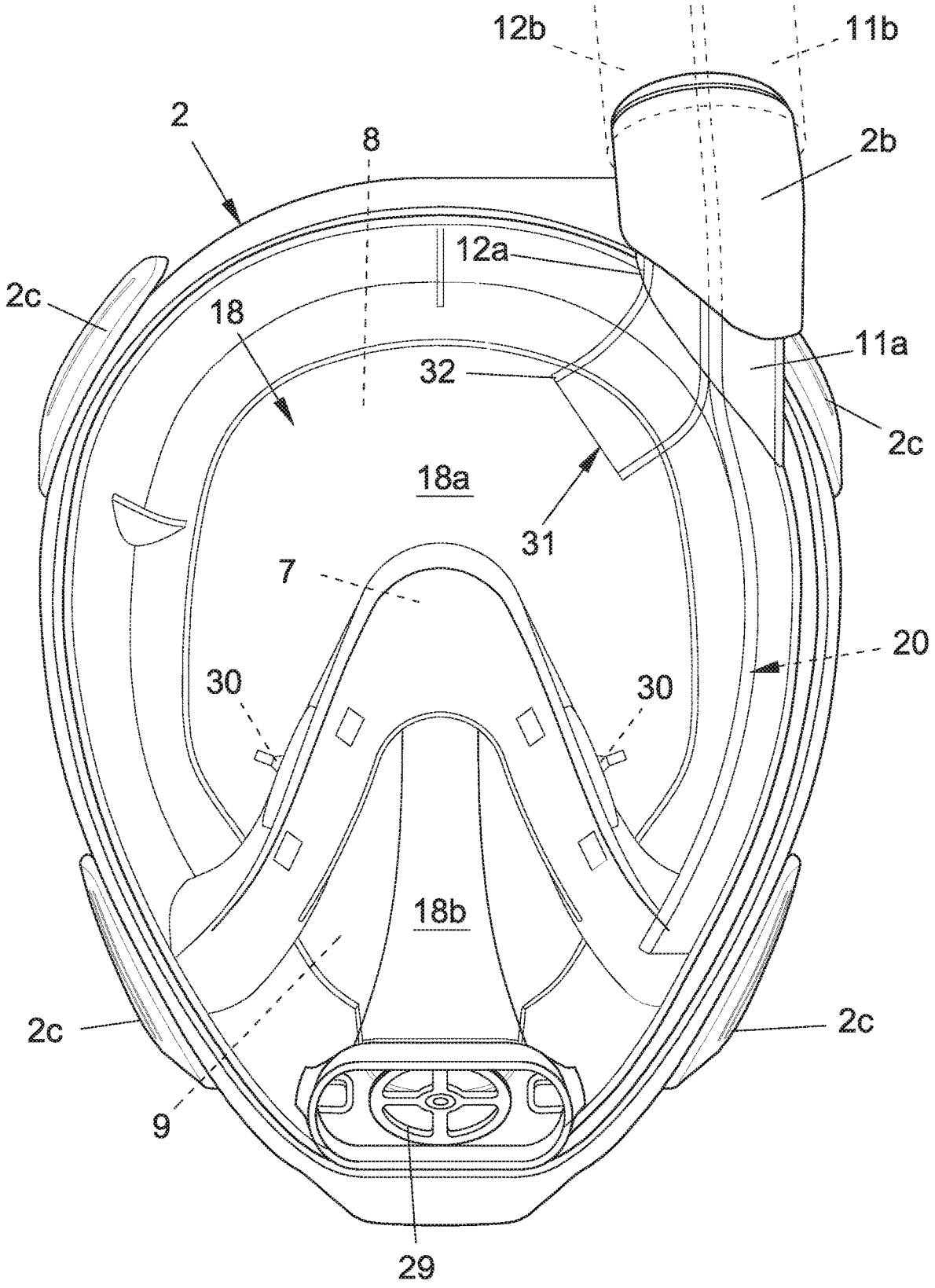
FIG. 4 shows a front view of the mask.
Figure 5:
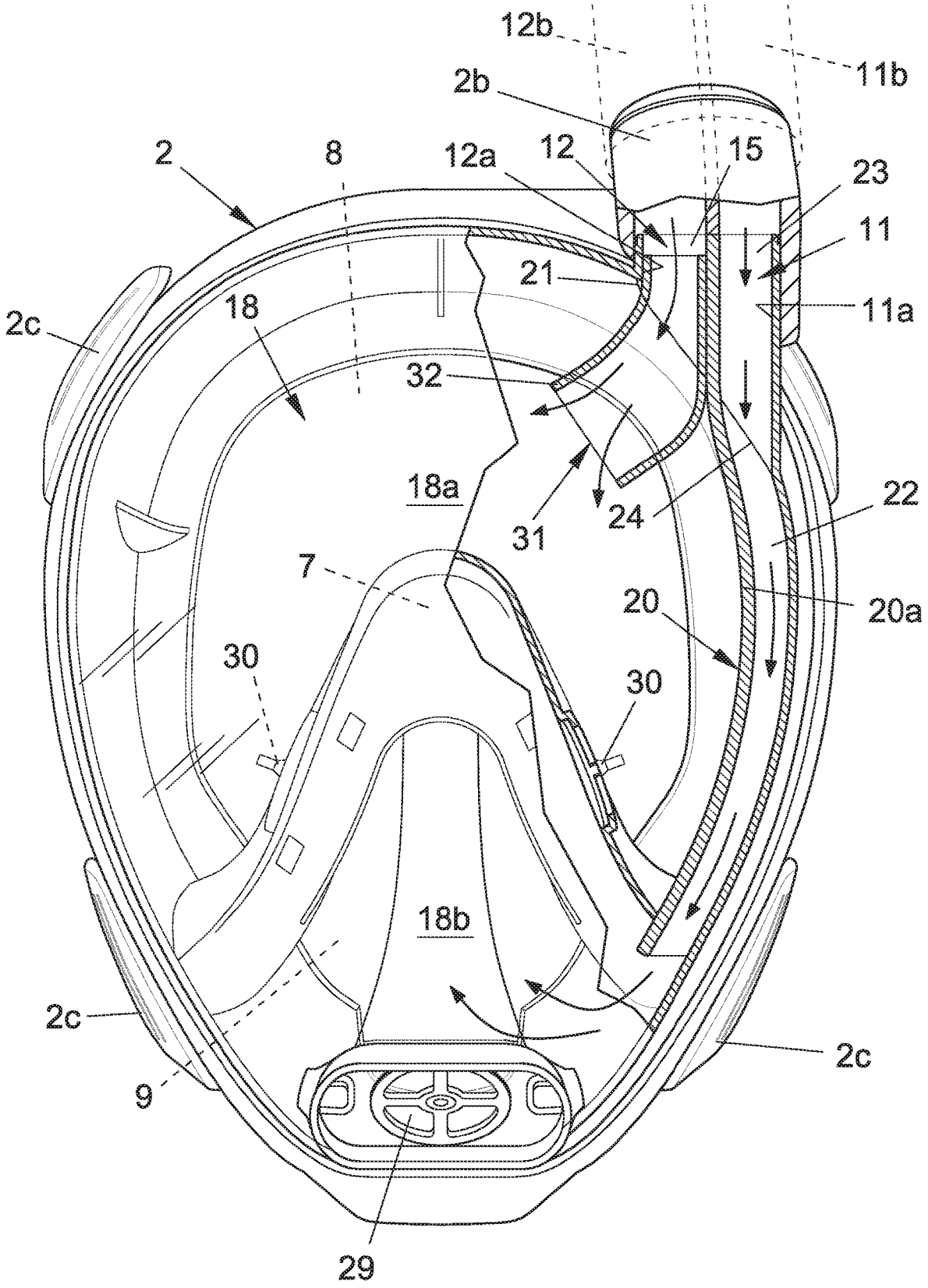
FIG. 5 shows a partially sectioned front view of the mask.
Figure 7:
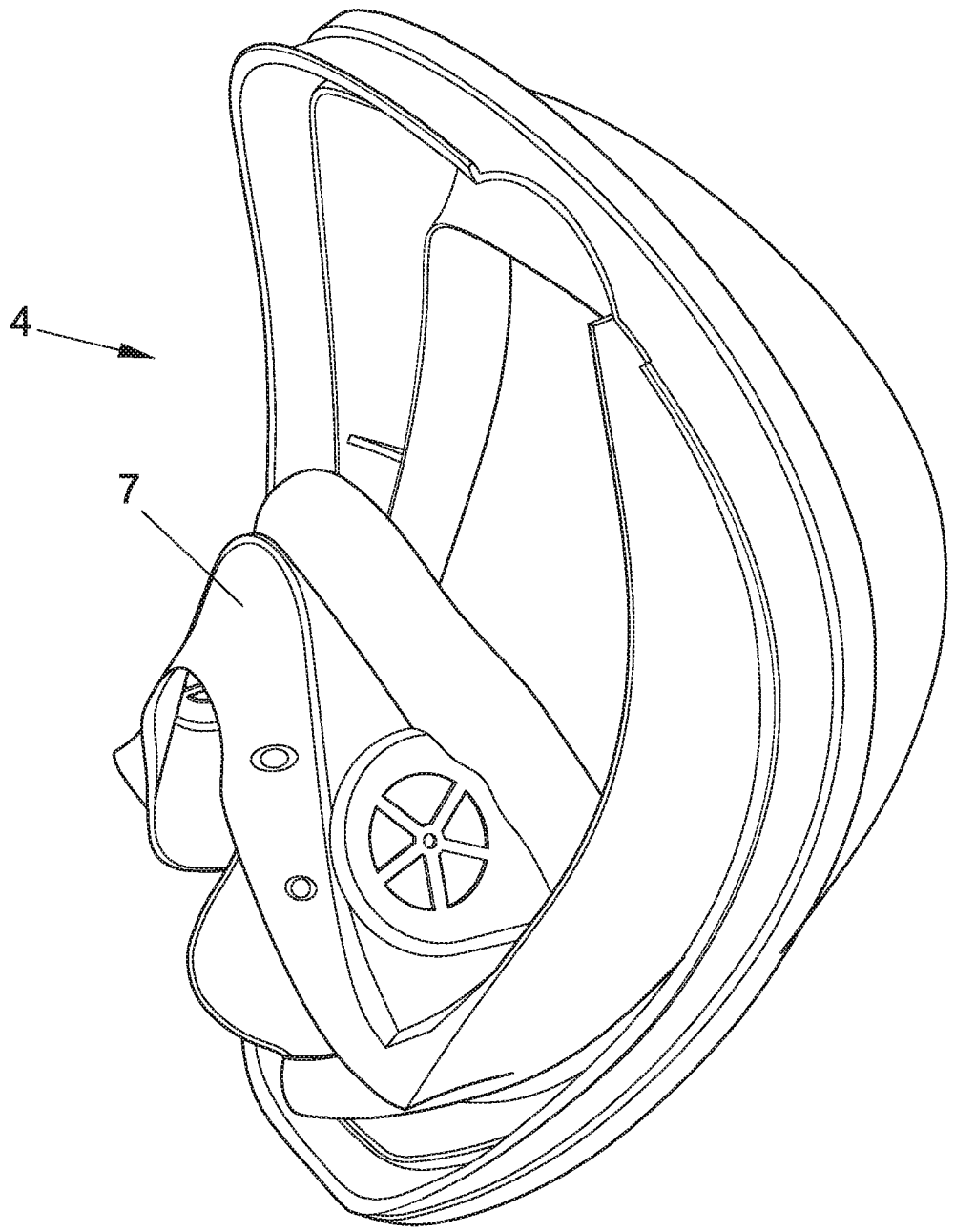
FIG. 7 shows the face mask.

With reference to the figures, a mask for snorkeling 1 is shown comprising a rigid frame 2, a transparent visor 3, a soft face mask 4 sealingly applicable to the face of the user.

The face mask 4 has a closed loop band 6 that is adaptable to the oval shape of the user's face and a membrane 7, shaped in particular as an upturned "V", which with the band 6 and the visor 3 delimits an upper viewing chamber 8 shaped so as to contain the eyes of the user and a lower breathing chamber 9 being shaped to contain the nose and the mouth of the user.

The mask 1 comprises a first two-directional circuit of forced air exchange induced by the breath 5 of the user.

This first circuit 5 connects the lower chamber 9 with the external atmospheric environment.

The mask 1 has a second bidirectional circuit of convective air exchange induced by the temperature difference 10 between the upper chamber 8 and the external atmospheric environment.

This second circuit 10 connects the upper chamber 8 with the external atmospheric environment.

Advantageously, the second circuit 10 comprises a diffuser 31 that extends inside the upper chamber 8 to the zone in front of the eyes of the user.

The diffuser 31 has a tubular shape.

In particular, the diffuser 31 is delimited by the internal wall of the visor 3 and by an independent marking out element 32 mounted on the internal wall of the visor 3.

In a preferred embodiment, the independent marking out element 32 mounted on the internal wall of the visor 3 has a U section.

Advantageously, the first 5 and the second circuit 10 are independent and separate, in other words they are not communicating and air does not pass from one circuit to the other.

The first circuit 5 comprises a first conduit 11 connecting the lower chamber 9 to the atmospheric environment external to the mask 1.

The second circuit 10 in turn comprises a second conduit 12 connecting the upper chamber 8 to the atmospheric environment external to the mask 1.

The first conduit 11 and the second conduit 12 are equipped with floating shutter means, for example of the type indicated in the figure with 13*a*, 13*b*.

Advantageously, said first conduit 11 has a passage section 14 which is free throughout its length when the shutter means 13*a*, 13*b* are in an open position, thus establishing a direct air connection of the lower chamber 9 to the atmospheric environment external to the mask 1.

Advantageously, also the second conduit 12 has a passage section 15 which is free throughout its length when the shutter means 13*a*, 13*b* are in an open position, thus establishing a direct air connection of said upper chamber 8 to the atmospheric environment external to the mask 1.

Advantageously, the diffuser 31 acts as an extension of the second conduit 12, directing the air uniformly to the zone in front of the eyes of the user.

The second conduit 12 comprises a proximal part 12*a* leading into the upper chamber 8 and a distal part 12*b* from the upper chamber 12.

The proximal part 12*a* of the second conduit 12 is connected to the visor 3 and is made as one piece with the visor 3, whereas the distal part 12*b* of the second conduit 12 is removably engaged with the proximal part 12*a* of the second conduit 12 and supports the shutter means 13*a*, 13*b*.

In greater detail, the diffuser 31 has a friction or shape coupling with the proximal part 12*a* of the second conduit 12.

For example, the diffuser 31 can be made of soft material and be fitted in the proximal part 12*a* of the second conduit 12.

Alternatively, the diffuser 31 can be made of rigid material and have mechanical connection means that is couplable with respective engagement seats obtained at the proximal part 12*a* of the second conduit 12.

Or also, the diffuser 31 and the proximal part 12*a* of the second conduit 12 can be connected by welding or gluing.

Or, lastly, the diffuser 31 can be made from a single mould as a single piece with the visor 3.

In greater detail, the diffuser 31 can be made of transparent or opaque material and can be made of the same material as the second conduit 12.

This diffuser 31 can have a rectilinear or curvilinear extent between a first end and a second end.

In particular, in order to improve circulation of the air in the upper chamber 8, the diffuser 31 can have a section variation in an axial direction.

For example, the diffuser 31 can have a section of the first area end that is greater, less or the same as the area of the section of the second end.

The first conduit 11 comprises a proximal part 11*a* leading into the lower chamber 9 and a distal part 11*b* from the lower chamber 9.

The proximal part 11*a* of the first conduit 11 is delimited by grooves 16, 17 placed respectively opposite the visor 3 and the face mask 4, whereas the distal part 11*b* of the first conduit 11 is removably engaged with the proximal part 11*a* of the first conduit 11 and supports the shutter means 13*a*, 13*b*.

In the illustrated case, the first conduit 11 and the second conduit 12 are positioned laterally with respect to a central symmetry axis of the visor 3 and are juxtaposed.

In particular, the distal part 11*b* of the first conduit 11 and the distal part 12*b* of the second conduit 12 are juxtaposed and share the shutter means that comprises a single shutter 13*a* operating on both the first conduit 11 and on the second conduit 12 and a single float 13*b* for driving the shutter 13*a*.

In one version of the invention that is not illustrated, the first conduit 11 and the second conduit are in a remote position from one another and in this case the shutter means comprises a shutter and a float dedicated to the first conduit 11 and a shutter and a float dedicated to the second conduit 12.

The position of the first conduit 11 and of the second conduit 12 can vary, for example, the first conduit 11 and the second conduit 12 can be positioned at a central axis of symmetry of the visor 3 or laterally but on an opposite side to a central symmetry axis of the visor 3.

The visor 3 shows in detail a front wall 18 and a lateral wall 19 that extends peripherally and to the rear of the front wall 18.

The front wall 18 has a flat portion 18*a* that in cooperation with the band 6 and the membrane 7 delimits the upper chamber 8, and a concave portion 18*b* from the side facing in use the face of the user, which, still in cooperation with the band 6 and the membrane 7, delimits the lower chamber 9.

The proximal portion 12*a* of the second conduit 12 in particular is completely outside the visor 3 and leads into a through hole 21 of the lateral wall 19 of the visor 3 that opens on the upper chamber 8.

The proximal portion 11*a* of the first conduit 11 has a portion 22 inside the visor 3 defined by the grooves 16, 17 and a portion 23 outside the visor 3.

The portion 22 inside the visor 3, which leads into the lower chamber 9, and the portion 23 outside the visor 3 are connected by a through hole 24 of the lateral wall 19 of the visor 3.

The groove 17 in the visor 3 is delimited by a partition 20 that rises behind the flat portion 18*a* of the front wall 18.

The partition 20 has a plate-shaped longitudinal body oriented orthogonally to the flat portion 18*a*.

A first part 20*a* of the partition 20 extends along a peripheral stretch of a flat portion 18*a* of the front wall 18 and a second part 20*b* extends beyond the flat portion 18*a* of the front wall 18.

The first part 20*a* of the partition 20 delimits the groove 17 in cooperation with the portion of the lateral wall 19 that it faces.

The second part 20*b* of the partition 20, which intersects the lateral wall 19 between the through holes 21, 24, separates the proximal portion 12*a* of the second conduit 12 from the portion 23 outside the visor 3 of the proximal portion 11*a* of the first conduit 11.

Along the outer peripheral edge of the lateral wall 19 of the visor 3 a groove 25 is formed housing a peripheral lip 26 of the face mask 4.

The peripheral lip 26 of the face mask 4 has, on the side opposite the lateral wall 19 of the visor 3, a peripheral groove 28 housing the frame 2.

The frame 2 in particular comprises a clamping frame 2*a* housed in the peripheral groove 28 of the peripheral lip 26 of the face mask 4, a connector 2*b* connecting each proximal part 11*a*, 12*a* and the corresponding distal part 11*b*, 12*b* of the first conduit 11 and of the second conduit 12, and of the attachments 2*c* for retaining elastic bands (not shown) of the mask 1 on the face of the user.

In one embodiment, in order to improve comfort, also a water drainage system is provided for draining the water that during use of the mask 1 succeeds in penetrating into the visor 3, both into the upper chamber 8 and into the lower chamber 9.

The water drainage system comprises a one-way valve 29 on the visor 3 in the lower part of the lower chamber 9 and one or more one-way valves 30 on the membrane 7, for example two one-way valves 30 positioned symmetrically on the opposite sides of the membrane 7.

The one-way valve 29 enables the water to be drained from the lower chamber 9 to the atmospheric environment outside the membrane 1, whereas the valves 30 enable the water to be drained from the upper chamber 8 to the lower chamber 9.

The one-way valves 29, 30 comprise a membrane shutter that flexes under the weight of the water.

Alternatively, in a more simplified version of the mask, no water drainage system need be provided.

The operation of the mask 1 is briefly as follows.

During surface swimming, the shutter 13*a* remains open, so that the first conduit 11 maintains in direct communication the lower chamber 9 with the external atmospheric environment to permit breathing through the first conduit 11 both during the inhalation and exhalation step.

Further, as the shutter 13*a* remains open during surface swimming, the second conduit 12 maintains the upper chamber 8 in direct communication with the external atmospheric environment. Advantageously, the presence of the diffuser 31 extending the conduit 12 prevents fogging up of the visor 3, especially in the zone in front of the eyes of the user.

When occasionally the head of the user submerges, the shutter 13*a* pushed by the float 13*b* shuts the first conduit 11 and the second conduit 12, thus preventing water accessing the lower chamber 9 and the upper chamber 8 of the visor 3.

The surface snorkeling mask as conceived herein is susceptible of many modifications and variants, all falling within the scope of the inventive concept; furthermore, all the details are replaceable by technically equivalent elements.

What is claimed is:

1. A mask (1) for surface snorkeling comprising a rigid frame (2), a transparent visor (3), a soft face mask (4) configured to be sealingly applicable to the face of the user and having a membrane (7) which delimits an upper viewing chamber (8) being shaped to contain the eyes of the user and a lower breathing chamber (9) being shaped to contain the nose and mouth of the user, the mask further comprises a first two-way circuit (5) of forced air exchange induced by a user's breathing, said first two-way circuit (5) connecting said lower breathing chamber (9) with the external atmospheric environment, and a second bidirectional circuit (10) of convective air exchange induced by the temperature difference between the upper viewing chamber (8) and the external atmospheric environment, said second bidirectional circuit (10) connecting said upper viewing chamber (8) with the external atmospheric environment for aeration of the upper viewing chamber (8) and comprising a diffuser (31) extending internally into the upper viewing chamber (8) towards a zone in front of the user's eyes.

2. The mask (1) for surface snorkeling according to claim 1, wherein said diffuser (31) has a tubular shape.

3. The mask (1) for surface snorkeling according to claim 1, wherein said diffuser (31) is delimited by an internal wall of the visor (3).

4. The mask (1) for surface snorkeling according to claim 1, wherein said first two-way circuit (5) comprises a first connecting conduit (11) for connecting said lower breathing chamber (9) to the atmospheric environment external to the mask (1), and said second bidirectional circuit (10) comprises a second connecting conduit (12) for connecting said upper viewing chamber (8) to the atmospheric environment external to the mask (1), and in that said first and second connecting conduits (11, 12) are equipped with floating shutter means (13*a*, 13*b*).

5. The mask (1) for surface snorkeling according to claim 4, wherein said first connecting conduit (11) has a passage section which is free throughout its length when said floating shutter means (13*a*, 13*b*) are in open position thus establishing a direct air connection of said lower breathing chamber (9) to the atmospheric environment external to the mask.

6. The mask (1) for surface snorkeling according to claim 4, wherein said second connecting conduit (12) has a passage section which is free throughout its length when said floating shutter means (13*a*, 13*b*) are in open position thus establishing a direct air connection of said upper viewing chamber (8) to the atmospheric environment external to the mask (1).

7. The mask (1) for surface snorkeling according to claim 4, wherein said diffuser (31) is arranged on an extension of the second connecting conduit (12).

8. The mask (1) for surface snorkeling according to claim 4, wherein said second connecting conduit (12) comprises a proximal part (12*a*) which opens in said upper viewing chamber (8) and a distal part (12*b*) from said upper viewing chamber (8), wherein said proximal part (12*a*) is connected to said visor (3) and is made in one-piece with said visor (3) and said distal part (12*b*) is removably engaged with said proximal part (12*a*) and supports said floating shutter means (13).

9. The mask (1) for surface snorkeling according to claim 8, wherein said diffuser (31) has a mechanical or friction or shape coupling with said proximal part (12*a*) of the second connecting conduit (12).

10. The mask (1) for surface snorkeling according to claim 4, wherein said first connecting conduit (11) comprises a proximal part (11*a*) which opens in said lower breathing chamber (9) and a distal part (11*b*) from said lower breathing chamber (9), wherein said proximal part (11*a*) is delimited by opposite grooves (16, 17) respectively of said visor (3) and said soft face mask (4), and said distal part (11*b*) is removably engaged with said proximal part (11*a*) and supports said floating shutter means (13*a*, 13*b*).

11. The mask (1) for surface snorkeling according to claim 10, wherein said visor (3) has a front wall (18) having a flat portion (18*a*) which delimits said upper viewing chamber (8) and an inwardly concave portion (18*b*) which delimits said lower breathing chamber (9), and a lateral wall (19) which extends peripherally and at the rear of said front wall (18), wherein said groove (17) in said visor (3) is delimited by a partition (20) that extends from said flat portion (18*a*).

12. The mask (1) for surface snorkeling according to claim 10, wherein said visor (3) has a front wall (18) having a flat portion (18*a*) which delimits said upper viewing chamber (8) and an inwardly concave portion (18*b*) which delimits said lower breathing chamber (9), and a lateral wall (19) which extends peripherally and at the rear of said front wall (18), wherein said soft face mask (4) has a peripheral lip (26) and wherein the external peripheral edge of said lateral wall (19) a groove (25) is formed to house said peripheral lip (26).

13. The mask (1) for surface snorkeling according to claim 12, wherein said peripheral lip (26) has a peripheral groove (28) to house said rigid frame (2).

14. The mask (1) for surface snorkeling according to claim 4, wherein said first connecting conduit and said second connecting conduit (11, 12) are juxtaposed.

15. The mask (1) for surface snorkeling according to claim 4, wherein said first and second connecting conduits (11, 12) are positioned laterally with respect to a central axis of symmetry of said visor (3).

* * * * *